United States Patent [19]

McKee

[11] 4,253,689

[45] Mar. 3, 1981

[54] SPRING LATCH MECHANISM

[75] Inventor: Donald S. McKee, Louisville, Colo.

[73] Assignee: Scott & Fetzer Company, Lakewood, Ohio

[21] Appl. No.: 33,149

[22] Filed: Apr. 24, 1979

[51] Int. Cl.[3] ..... E05C 17/30

[52] U.S. Cl. ..... 292/338; 160/67

[58] Field of Search ..... 135/22, 24, 5 AT; 292/338, 262, 152, 209, 267, 278, DIG. 37

[56] References Cited

U.S. PATENT DOCUMENTS

| | | | |
|---|---|---|---|
| 2,454,794 | 11/1948 | Hakonson | 292/267 X |
| 3,828,805 | 8/1974 | Thur | 135/22 |
| 4,117,876 | 10/1978 | Bennett | 135/5 AT |

*Primary Examiner*—Richard E. Moore

*Attorney, Agent, or Firm*—Gary M. Polumbus

[57] ABSTRACT

A spring latch mechanism for releasably retaining longitudinally slidable members in preselected relationships includes an elongated strip of semi-rigid resilient material having a pair of longitudinally spaced protuberances extending away from opposite faces of the strip. The strip is of flat V-shaped longitudinal cross-section and has a pivot location so that the protuberances are resiliently urged into openings in the slidable members to lock the members into preselected relationships. At least one of the protuberances can be depressed in a manner such that the other protuberance is moved out of the opening in which it was received to allow the members to slide longitudinally into another desired relationship. The strip is adapted to be disposed in a space between the longitudinally slidable members in a concealed location.

4 Claims, 7 Drawing Figures

SPRING LATCH MECHANISM

BACKGROUND OF THE INVENTION

Numerous devices have been employed for locking longitudinally slidable members in preselected positions. A commonly used system is a set screw which is threadably received in one member and adapted to be advanced tightly against the second member to prevent relative sliding movement. Some such set screws employ a knob which can be manually turned so that a screwdriver or other such implement is not needed.

Other systems employed for releasably retaining longitudinally slidable members in preselected positions include a button attached to one of the slide members and biased away therefrom so as to fit into one of a plurality of openings provided in the other of the members to prevent relative sliding movement. The button is depressible to remove it from the opening so that the members can be slid relative to each other into different positions.

One other system for releasably locking longitudinally slidable members in preselected positions utilizes a multipiece unit having a button protruding through one of the slidable members at an easily accessible location and a second button protruding through one of a plurality of holes in the other sliding member in a nonvisible position so that upon depression of the first button the second button is removed from its locking position in one of the openings whereby the members can be slid until a desirable relative relationship is obtained. Upon obtaining the new relationship the first button can be released to allow the second button to protrude into another hole in the second member. This system, however, consists of several component parts which make it relatively expensive to manufacture and more susceptible to malfunction than a simpler system.

SUMMARY OF THE INVENTION

The present invention is concerned primarily with a new and improved spring latch mechanism for retaining longitudinally slidable members in preselected positions and more particularly with a spring latch mechanism which can be employed in retractable awnings to retain brace members in preselected positions.

The spring latch mechanism or system of the present invention includes as a primary element thereof an elongated strip of semi-rigid resilient material, such as spring steel, which has been shaped and formed to cooperate with openings provided in adjacent slidable members to releasably lock the members in preselected relative positions.

The strip is of leaf spring configuration and formed to have a pair of protrusions or buttons thereon each extending away from the strip in opposite directions at longitudinally spaced locations. A first of these buttons is adapted to protrude through an opening in one of the slidable members while the other protrusion is adapted to fit into any one of a plurality of openings in the other slidable member. The strip is pivotally secured to one of the slidable members at a location between the two protrusions so that depression of the first protrusion will cause the second protrusion to retract from its disposition in a hole in the second slidable member, and release of the first protrusion will allow the second protrusion to be forced into a selected opening in the second slidable member due to a bias placed thereon by the leaf spring configuration of the strip.

Accordingly, it is a primary object of the present invention to provide a new and improved spring latch mechanism that can releasably retain slidably related members in preselected positions.

It is another object of the present invention to provide an inexpensive spring latch mechanism utilizing a unitary part which is virtually free of malfunction.

Other objects, advantages and capabilities of the present invention will become more apparent as the description proceeds when taken in conjunction with the accompanying drawings.

DESCRIPTION OF THE PREFERRED EMBODIMENT

Figure 1:
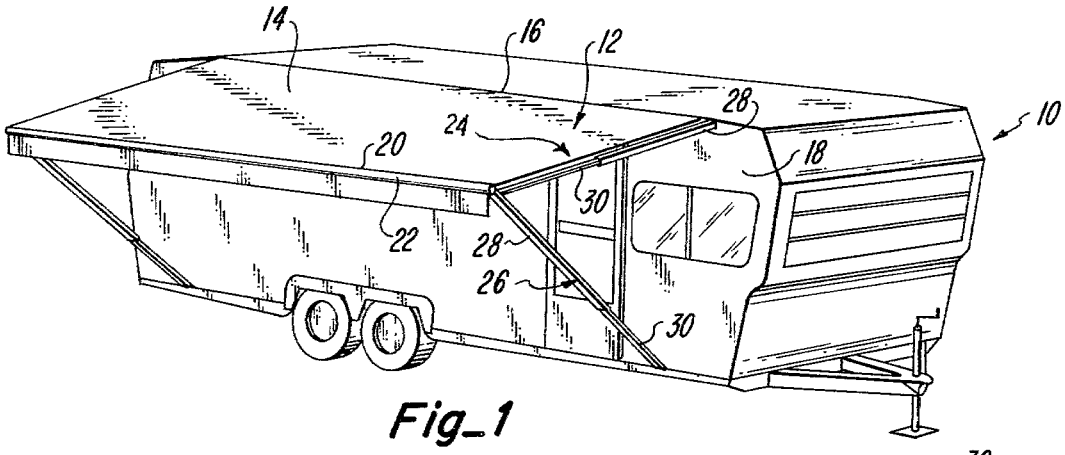
FIG. 1 is a perspective view of a house trailer having a retractable awning thereon incorporating the present invention.
Figure 2:
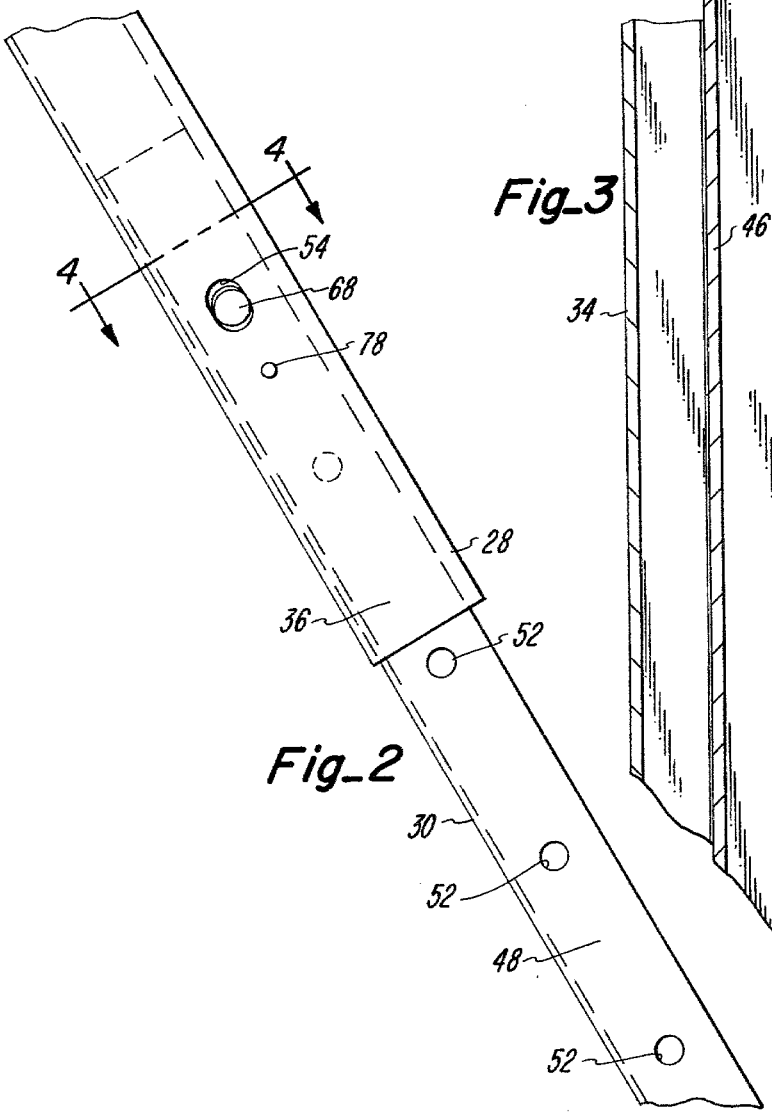
FIG. 2 is an enlarged fragmentary side elevation of a brace member utilized in the retractable awning shown in FIG. 1.
Figure 3:
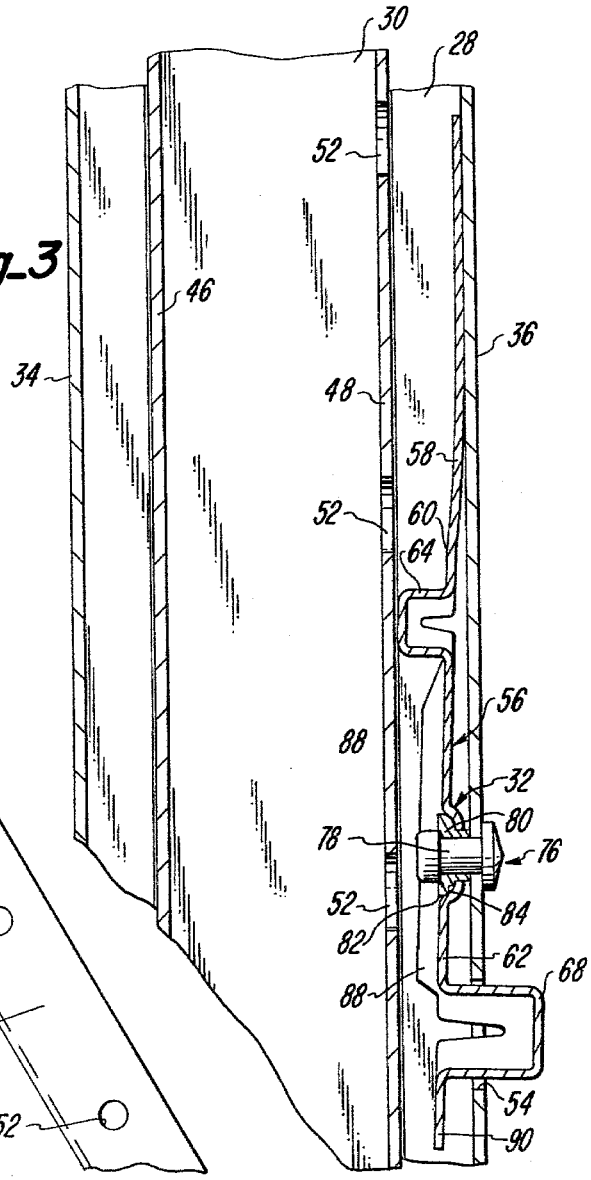
FIG. 3 is an enlarged fragmentary longitudinal section taken through a brace member of the retractable awning shown in FIG. 1.
Figure 4:
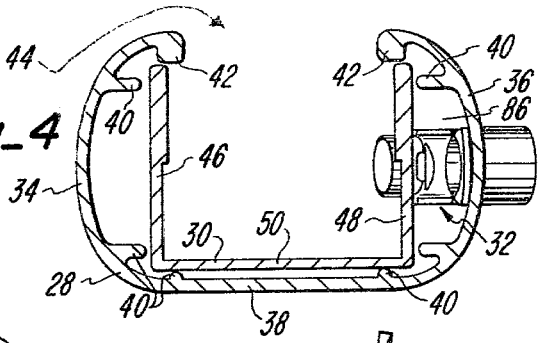
FIG. 4 is a section taken along Line 4—4 of FIG. 2.

Referring first to FIG. 1, a house trailer 10 is illustrated having a retractable awning 12 mounted along one side thereof. The retractable awning 12 includes an awning sheet 14 anchored along an inner edge 16 to a vertical side wall 18 of the house trailer with the opposite or outer edge 20 secured to a lead bar 22 which in the preferred form, is a roll bar adapted to be moved between a retracted position (not shown) immediately adjacent to the side wall and an extended position spaced laterally from the side wall (FIG. 1) in which position the awning sheet is extended across an area immediately adjacent to the house trailer. The awning sheet 14 is supported at opposite ends by a pair of upper brace members 24 and a pair of lower brace members 26, each of which includes inner and outer sliding arms 30 and 28 respectively so that the braces are longitudinally extensible and retractable to move the awning between the extended and retracted positions respectively. Both the upper brace members and the lower brace members incorporate latching mechanisms or systems 32 to secure the inner and outer arms in selected longitudinal positions. Both of the brace members utilize the latch system 32 as illustrated in FIGS. 2 through 4 which will be described in more particularity hereinafter.

The latch system 32 will be described in connection with the lower brace members 26 which, as mentioned previously each consist of inner and outer sliding arms 30 and 28 respectively. The outer sliding arm 28, as seen best in FIG. 4, is generally C-shaped in transverse cross section having arcuate side walls 34 and 36 and a generally flat bottom wall 38 to define an elongated channel therewithin. Each arcuate side wall 34 and 36 and the bottom wall 38 has a pair of elongated inwardly directed guide fingers 40 extending the entire length of the outer arm. The guide fingers, in cooperation with inturned ends 42 on opposite sides of the opening 44 in the outer arm cooperate in defining a pathway along which the inner arm 30 is confined for longitudinal sliding movement relative to the outer arm 28.

The inner arm 30 is also of generally C-shaped tranverse cross section having a pair of parallel side walls 46 and 48 and a bottom wall 50 which are substantially parallel to the corresponding walls of the outer arm 28. The side wall 48 of the inner arm is provided with a plurality of longitudinally spaced circular openings 52 therethrough, as best illustrated in FIG. 2, while the corresponding side 36 of the outer arm 28 has one such circular opening 54 which is of slightly larger diameter than the openings 52 in the inner arm. The openings, 52 and 54, as will become more clear later, are adapted to cooperate with an elongated spring strip 56 in facilitating relative movement of the inner and outer arms between selected positions.

Figure 6:
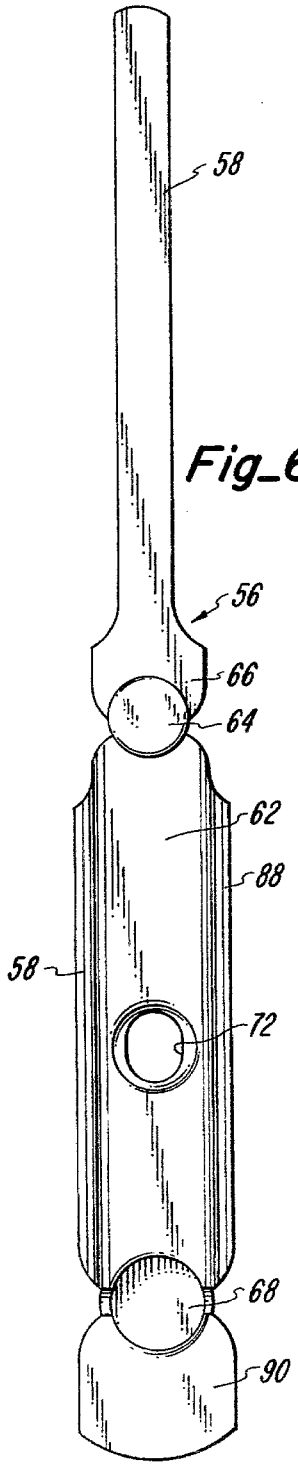
FIG. 6 is a top plan view of the strip member utilized in the latch mechanism of the invention.
Figure 7:
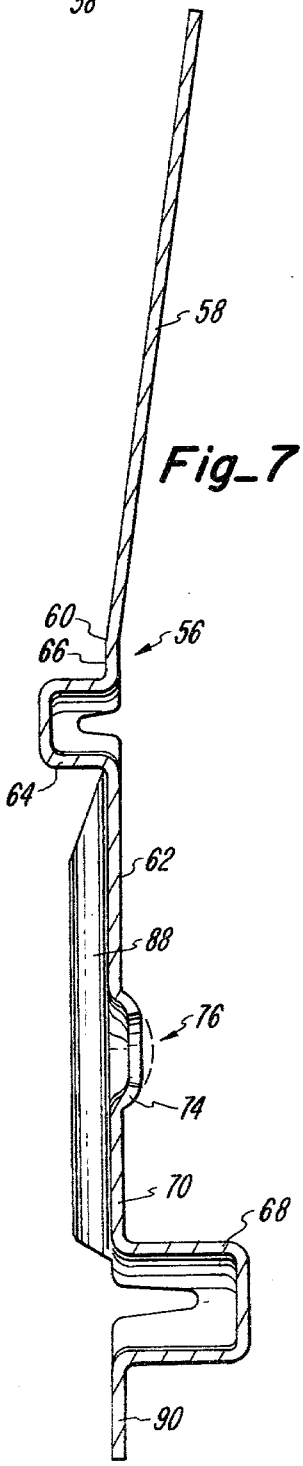
FIG. 7 is a longitudinal central cross-section of the strip member shown in FIG. 6.

The spring strip 56 is of generally V-shaped longitudinal cross section when free standing and functions as a leaf spring. The strip 56, as seen best in FIG. 6, includes a relatively thin elongated portion 58 extending in one direction from the apex 60 and a relatively broad elongated portion 62 extending in the opposite direction from the apex 60. Near the apex, the strip is deformed to form a cylindrical protrusion or button 64 extending away from one flat side 66 of the strip while a similar but larger protrusion or button 68 is formed in the broad portion 62 of the strip near the terminal end of that portion. As will be appreciated, the relatively large protrusion 68 extends away from the opposite flat side 70 of the strip for a purpose to be described later.

At approximately midway between the large and small protrusions 68 and 64 respectively an opening 72 is provided through the broad portion of the strip and a raised arcuate shoulder 74 surrounding the opening is provided to extend in the same direction as the large protrusion 68. The shoulder 74 and opening 72 define a pivot location 76 for pivotally securing the strip to the outer arm 28 as by a rivot 78 and collar 80 shown best in FIG. 5.

The collar 80 is inserted into the opening 72 in the strip and has a circular arcuate surface 82 adapted to mate with a mating surface 84 on the shoulder 74 while the rivot 78 extends through the collar and is secured in position in a conventional manner so that the strip 56 can pivot or rock about the collar.

When the strip 56 is positioned in a space 86 between the inner and outer arms 30 and 28 respectively so that the large protrusion 68 extends through the opening 54 in the outer arm and the small protrusion 64 extends through one of the openings 52 in the inner arm, inward movement of the large protrusion is resisted by the flexible but resilient thin portion 58 of the strip, which as can be appreciated, is bent at the apex 60 so that the thin portion engages the side wall 36 of the outer portion 28. The broad portion 62 of the strip is bent along opposite sides to form raised flanges 88 which reinforce the broad portion and thereby substantially prevent it from flexing.

The strip is preferably made of a semi-rigid but resilient material such as spring steel so that the broad portion 62 can be rigidified with the side flanges 88 to form a relatively rigid section while the thin portion 58 can flex to function like a leaf spring to bias the protrusions 64 and 68 into the openings in the inner and outer arms respectively for desired operation of the latch system. As will be appreciated, the broad portion 62 of the strip has a tail 90 beyond the large protrusion 68 which is adapted to abut the side wall 36 of the outer arm 28 when the large protrusion is in a protruding position relative to the opening 54 as illustrated in FIG. 5.

Figure 5:
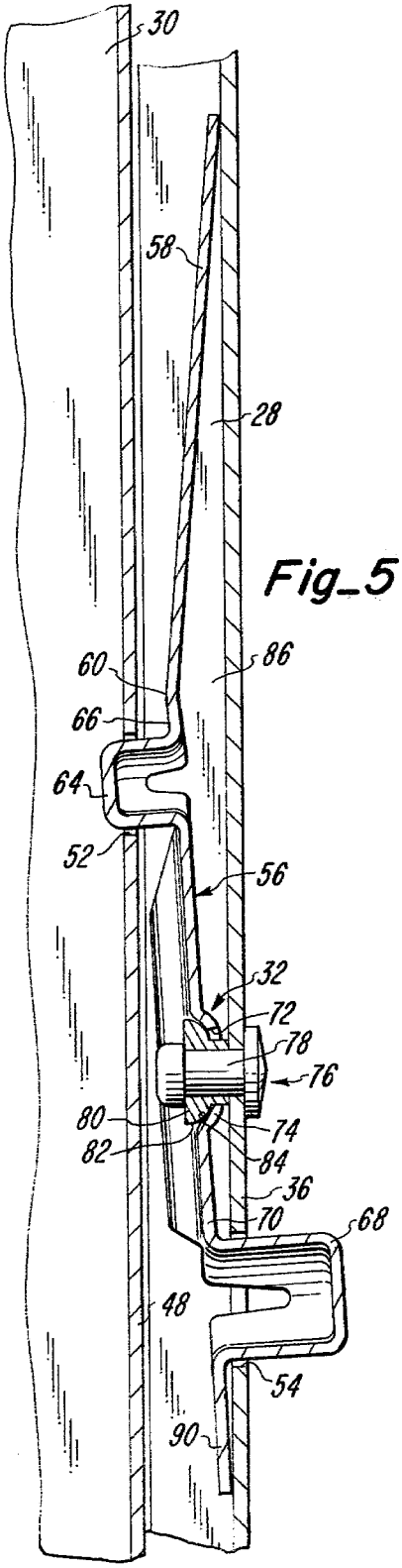
FIG. 5 is a fragmentary longitudinal section similar to FIG. 3 with the latch mechanism in a locking position.

As illustrated best in FIGS. 4 and 5, the spring latch system 32 in its operative position is disposed so that the large protrusion 68 extends through the opening 54 provided in the side wall 36 of the outer arm 28 while the smaller protrusion 64 extends through one of the longitudinally spaced openings 52 provided in the side wall 48 of the inner arm 30. The protrusions of course are yieldingly urged into these openings by the spring bias of thin portion 58 of the strip 56. Upon depression of the large protrusion, which extends outwardly in a readily accessible location, the broad portion 62 of the strip will pivot about the pivot location 76 thereby withdrawing the small protrusion from its position in an opening 52 of the inner arm so that the inner arm can be slid longitudinally relative to the outer arm. Once the small protrusion is aligned with another desired opening 52 in the inner arm, the small protrusion will snap into this opening due to the bias placed thereon by the narrow portion 58 of the strip thereby again securely locking the inner and outer arms and preventing relative longitudinal movement.

A preferred embodiment of the present invention has been described with a degree of specificity to enable a relatively full and complete understanding of that embodiment. It should be understood, however, that the present invention is defined by the following claims which are intended to encompass a scope of the invention to the extent that the prior art allows.

What I claim is:

1. In a retractable awning adapted to be mounted on a generally vertical surface wherein said awning includes an awning sheet operatively connected along an inner edge to said surface and along an outer edge to a bar adapted to be moved to and from said surface to move said awning sheet between extended and retracted conditions, and at least one brace member adapted to be extended between said surface and said bar when the awning sheet is in an extended condition, said brace member including at least two elongated arms operatively connected together in longitudinally slidable relationship, said arms each having at least one opening therethrough and a space therebetween, wherein the improvement comprises a latch mechanism adapted to releasably retain said arms in fixed relationship, said latch mechanism including a semi-rigid elongated resilient strip having a protuberance on each side thereof, said protuberances being displaced longitudinally of said strip with one of said protuberances being located near a first end of said strip and the other of said protuberances being located near the longitudinal center of said strip, said strip having a generally flat V-shaped longitudinal cross-section in a free standing condition and being shaped to fit into said space and cooperate with at least one of said arms to bias said strip into a position wherein said protuberances can protrude through the openings in said arms, said strip further including pivot means at a pivot location disposed between said protuberances, and wherein said pivot means includes a raised shoulder surrounding a hole through said strip.

2. In a retractable awning adapted to be mounted on a generally vertical surface wherein said awning includes an awning sheet operatively connected along an inner edge to said surface and along an outer edge to a bar adapted to be moved to and from said surface to move said awning sheet between extended and retracted conditions, and at least one brace member adapted to be extended between said surface and said bar when the awning sheet is in an extended condition, said brace member including at least two elongated arms operatively connected together in longitudinally slidable relationship, said arms each having at least one opening therethrough and a space therebetween, wherein the improvement comprises a latch mechanism adapted to releasably retain said arms in fixed relationship, said latch mechanism including a semi-rigid elongated resilient strip having a protuberance on each side thereof, said protuberances being displaced longitudinally of said strip with one of said protuberances being located near a first end of said strip and the other of said protuberances being located near the longitudinal center of said strip, said strip having a generally flat V-shaped longitudinal cross-section in a free standing condition and being shaped to fit into said space and cooperate with at least one of said arms to bias said strip into a position wherein said protuberances can protrude through the openings in said arms, pivot means on said strip at a pivot location disposed between said protuberances, and fastening means adapted to pivotally attach the strip to one of said arms at said pivot location.

3. A single piece spring latch mechanism for releasably retaining relatively slidable members in a predetermined relationship wherein each of said members has at least one opening therethrough and a space exists between said members, said mechanism consisting of:

a semi-rigid elongated resilient strip which in a free standing condition has a generally flat V-shaped longitudinal cross-section, said strip further having at least one protuberance on each side thereof, said protuberances being displaced longitudinally of said strip, said strip being shaped to fit into said space and having means thereon adapted to engage at least one of said members to thereby bias said strip into a position wherein said protuberances protrude into said openings in said members.

4. In a retractable awning adapted to be mounted on a generally vertical surface wherein said awning includes an awning sheet operatively connected along an inner edge to said surface and along an outer edge to a bar adapted to be moved to and from said surface to move said awning sheet between extended and retracted conditions, and at least one brace member adapted to be extended between said surface and said bar when the awning sheet is in an extended condition, said brace member including at least two elongated arms operatively connected together in longitudinally slidable relationship, said arms each having at least one opening therethrough and a space therebetween, wherein the improvement comprises a single piece latch mechanism adapted to releasably retain said arms in fixed relationship, said latch mechanism comprising a semi-rigid elongated strip which in a free standing condition has a generally flat V-shaped longitudinal cross-section, said strip further having at least one protuberance on each side thereof, said protuberances being displaced longitudinally of said strip, said strip being shaped to fit into said space and having means thereon adapted to engage at least one of said arms to thereby bias said strip into a position wherein said protuberances protrude into the openings in said arms.

* * * * *